US006216426B1

(12) United States Patent
De Saint-Sauveur

(10) Patent No.: US 6,216,426 B1
(45) Date of Patent: Apr. 17, 2001

(54) LEAKTIGHT CHAMBER, METHOD OF MANUFACTURE AND OF PACKAGING LIQUID IN THESE CHAMBERS

(75) Inventor: Xavier De Saint-Sauveur, Ferney-Voltaire (FR)

(73) Assignee: Carapak Braintrust NV, Curacao (AN)

( * ) Notice: Subject to any disclaimer, the term of this patent is extended or adjusted under 35 U.S.C. 154(b) by 0 days.

(21) Appl. No.: 09/335,146

(22) Filed: Jun. 17, 1999

Related U.S. Application Data

(63) Continuation of application No. PCT/IB97/01584, filed on Dec. 19, 1997.

(51) Int. Cl.[7] ..... B65B 43/04
(52) U.S. Cl. ..... 53/455; 493/920; 493/931
(58) Field of Search ..... 53/133.1, 455; 493/210, 929, 920, 931

(56) References Cited

U.S. PATENT DOCUMENTS 3,847,280 * 11/1974 Poncy .
4,793,121 * 12/1988 Jamison .
5,121,996 * 6/1992 Scarrow .
5,937,617 * 8/1999 Yeager .

FOREIGN PATENT DOCUMENTS 2 711 115 4/1995 (FR) .
WO 95 23742 9/1995 (WO) .
WO 97 18143 5/1997 (WO) .

* cited by examiner

*Primary Examiner*—Eugene Kim
(74) *Attorney, Agent, or Firm*—Henderson & Sturm LLP

(57) ABSTRACT

A bag for packaging liquid formed using plastic in film form is disclosed. The bag includes a leaktight chamber for liquid and a pocket, adjacent to the chamber, in which a pipe for withdrawing the liquid is housed. Access is provided to the inside of said pocket. An opening is formed through part of the wall of the pocket, adjacent to the chamber, to allow the withdrawing pipe to enter the chamber in a leaktight fashion. The opening is situated at the end of a tubular element of decreasing section, at the place where the section is the smallest with the element being formed from a film of plastic forming one wall of the pocket adjacent to the chamber. The tubular element accommodates the pipe for withdrawing the liquid from the chamber and is at least equal to that of the opening, so that the tubular element forms a seal around the withdrawing pipe.

21 Claims, 6 Drawing Sheets

LEAKTIGHT CHAMBER, METHOD OF MANUFACTURE AND OF PACKAGING LIQUID IN THESE CHAMBERS

This is a continuation of co-pending PCT Application Ser. No. PCT/IB97/01584, filed on Dec. 19, 1997, entitled LEAKTIGHT CHAMBER, METHOD OF MANUFACTURE AND OF PACKAGING LIQUID IN THESE CHAMBERS, the disclosure of which in its entirety is incorporated by reference thereto herein.

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to a bag for packaging liquid formed using a film of plastic, comprising a leaktight chamber for the liquid and a pocket, adjacent to this chamber, in which a pipe for withdrawing the liquid is housed, means being provided to give access to the inside of the said pocket, an opening being formed through part of the wall of this pocket, adjacent to the said chamber, to allow the said withdrawing pipe to enter the said chamber in a leaktight fashion. This invention also relates to a method for the manufacture of bags and for packaging liquid continuously in these bags.

2. Description of the Prior Art

There has already been proposed, especially in WO 95/23742, a bag for packaging liquid comprising an incorporated valve for controlling the outlet of liquid and which can be manufactured continuously from a film of thermoplastic. It has been proposed that a drinking straw be associated with this bag to allow the liquid to be accessed through the valve that consists of a passage formed between two layers of film which normally touch and which open when the drinking straw is inserted. Thus, when the drinking straw is withdrawn at least partially from the passage that forms the valve, this passage closes back up and the liquid can no longer get out. The drawback with this system lies in the fact that by withdrawing the drinking straw, this straw makes liquid in the passage of the valve come out, gradually soiling the outside of the bag.

Clearly it is not easy to make an effective seal in this kind of bag, even less so when this bag is equipped with a valve of the aforementioned type. The edges of the passage delimiting the valve are made by welding together films of thermoplastic. Now, by welding these films together, the structure of the substance of the film is locally altered and the film becomes amorphous and loses some of its elasticity, so detracting from the quality of seal that can be formed. The use of an element added on to the inlet end of this valve-forming passage is also precluded. This clearly demonstrates the complexity of the problem to be solved, it being necessary for the solution to be appropriate to the very low cost price that can be tolerated for a bag of this type. Other problems associated with this design of bag, and the solutions to which are combined and re-used in the present invention, have already been provided by the inventor of the present invention and have been covered by other protections. These in particular include the question of incorporating a drinking straw into the bag, and the tamper-proofing of this bag for obvious health and safety reasons.

By contrast, the problems associated with sealing and with a certain method of manufacture and of packaging the liquid continuously had hitherto not yet been dealt with satisfactorily. One of these problems is associated with incorporating a drinking straw into a closed pocket of the packaging in a manufacturing process that uses a material in the form of continuous strip.

BRIEF SUMMARY OF THE INVENTION

The object of the present invention is specifically to provide a solution to the problem of sealing, and to that of manufacturing bags and packaging liquid continuously in such bags, allowing in particular the use of known designs of machine even if these machines need after all to be converted substantially so that they can be adapted to the manufacture and packaging of these bags.

Thus the subject of the present invention is first of all a bag for packaging liquid of the aforementioned type as defined in Claim 1. This tubular element of decreasing section is obtained by stretching out a plastic film and thus allows the film to maintain its elasticity which guarantees effective sealing. What is more, this is a very simple solution perfectly suited to the product for which it is intended.

As a preference, the wall of the pocket containing the said withdrawing pipe is secured to a tab cut from one layer of film intended to form the leaktight chamber. This tab makes it possible to guarantee that the access to the drinking straw which acts as a pipe for dispensing the liquid has not been tampered with.

Advantageously, the opening formed at the end of the tubular element forming the seal communicates with one end of a passage forming a valve between this opening and the inside of the leaktight chamber, the pocket of the bag being formed between a first layer of film forming one of the walls of the said passage and a second layer of film which is appreciably narrower than the first layer and secured to the tab for opening the pocket. Thanks to this arrangement, a saving of one thickness of film is made because one of the walls of the pocket is formed by one of the films of the valve passage. This saving in thickness has an advantage when the strip of part-finished bags has to be wound onto a reel to be sent to a liquid-packaging unit. The added thickness consisting of two thicknesses of film forming the walls of the pocket can thus be reduced by half, also reducing the difference in thickness from one edge of the reel of part-finished bags to the other.

As an alternative, this pocket may however be formed in the fold of a film folded on itself. As a preference, this fold may lie adjacent to one end of the passage controlling the flow of the liquid and the tubular element forming the seal may extend over part of this passage.

Another subject of this invention is a method for the manufacture of bags and for the packaging of liquid continuously in these bags according to claim 9. One of the advantages of this method is that it allows the bags to be filled and the straws to be inserted laterally, one of the longitudinal edges of the material in strip form intended to form one of the edges of these bags remaining open until the time of filling. Thus the drinking straw can be inserted laterally along the axis of the seal and of the valve passage when there is this passage, and a liquid-supply pipe can be slipped between the walls of the bag, along its edge that coincides with the longitudinal edge of the material in strip form. This longitudinal edge is welded up as the material in strip form progresses, just before filling.

Advantageously, the method takes place in two separate phases, one consisting in forming a continuous strip of part-finished bags, and the second consisting in forming the tubular seal, in inserting the withdrawing pipe therein and in packaging the liquid in the chamber. The advantage of this method of production is that it allows the part-finished bags to be manufactured and the liquid to be packaged in two separate production units, the packager of the product not necessarily being called upon to solve the problems involved in the manufacture of a bag of this kind.

Thus the packager of liquid into the packaging can then use the part-finished bags thus produced just like simple sheets or films used for packaging liquid in sachets, bags or cartons, carrying out the packaging using conventional machinery, so that in order to package the liquid he wishes to sell in the bags according to the invention, especially bags with valves, all the liquid packager needs to do is replace the customary sheet materials or simple extruded films with the part-finished bags according to the present invention.

One of the main advantages of the chamber that is the subject of the invention is that there is a film seal over the valve passage and this means that by piercing this film seal, not by cutting it, but by a point deformation of the film seal towards the valve passage until it bursts, an annular seal which is slightly conical is obtained and guarantees elastic clamping of the drinking straw, giving a seal that makes it possible to prevent any liquid in the valve passage from escaping.

In addition, the two faces of the chamber which come from the same sheet folded onto itself do not become offset from one another, which means that the same is true of the printed wording on the two faces of this chamber.

Thanks to the packaging method according to the invention, the pocket which is intended to house the bent-over part of the drinking straw which lies outside the valve passage is produced after the drinking straw has been inserted into the entry to this passage, which means that the drinking straw does not pull on the lateral welds of the pocket.

Other advantages and other alternative forms will become clear during the description which will follow, given with the aid of the appended drawing which illustrates, very diagrammatically and by way of an example, one embodiment and one alternative form of the chamber that is the subject of this invention, and the corresponding ways of implementing the manufacturing and packaging methods that are subjects of this invention.

DETAILED DESCRIPTION OF THE INVENTION

Figure 1:
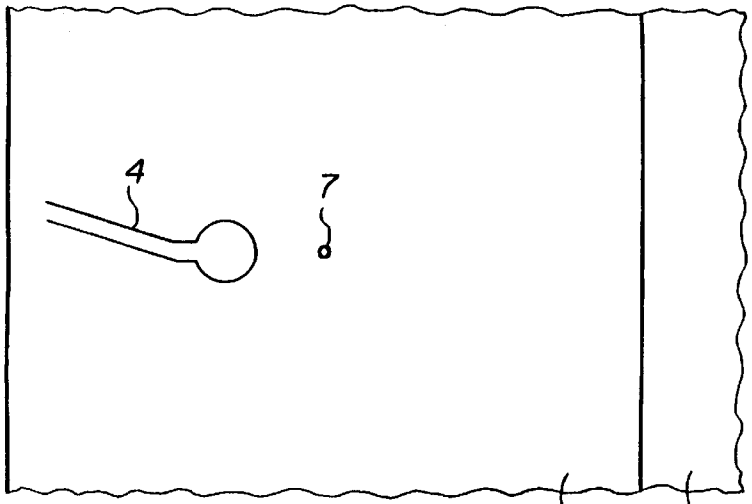
FIG. 1 is a plan view, illustrating a first phase of the manufacturing method.
Figure 2:
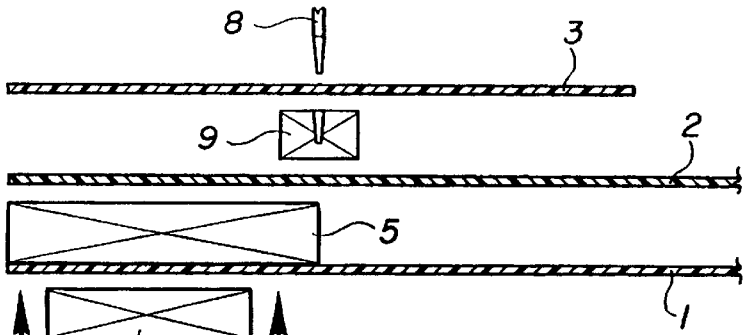
FIG. 2 is a sectional view of FIG. 1.

FIGS. 1 and 2 depict three superimposed sheets 1, 2, 3 of material in sheet form, the third sheet of which is appreciably narrower than the first two. The first sheet 1, which is intended to form the wall of a leaktight chamber, in this example a bag for packaging a liquid, especially a drink, preferably consists of a multi-layer plastic sheet like those conventionally used for packaging food products. The various layers of these multi-layer sheets may be formed of different plastics or of the same plastic, allowing them to be recycled. Of course, the bag that is the subject of the present invention is not restricted to the packaging of drinks, but can also be used for any kind of liquid.

The second sheet 2 is a film of extruded plastic, especially polyethylene, as is the third sheet 3. It should, moreover, be emphasized here that even though the sheets 2 and 3 have been depicted as initially being two separate sheets, they could also start out as a common sheet, folded about an axis which is longitudinal to that of this sheet in strip form, in order then to form the two sheets 2 and 3 of different widths depicted in FIGS. 1 and 2.

Figure 8:
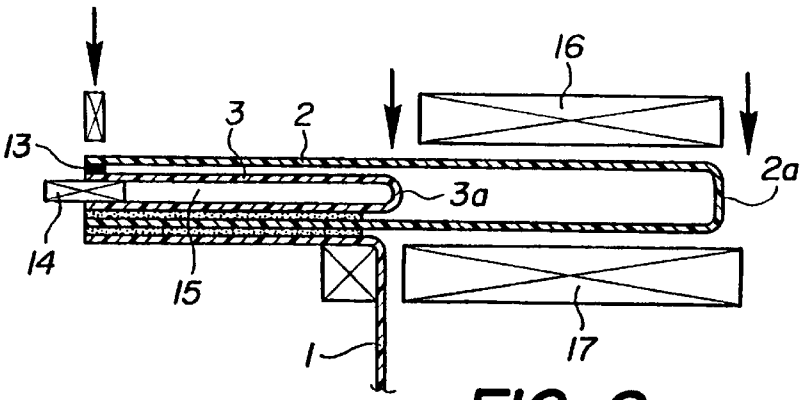
FIG. 8 is a sectional view of FIG. 7.

As another alternative, the sheets 2 and 3 could come from a tubular film, with a slightly raised pressure inside, the superimposed layers being obtained by progressively flattening the tube and gradually folding a portion of this tube longitudinally inwards. In this way, four superimposed layers are obtained, two of which are narrower than the other two, the layers being all joined together, as illustrated by FIG. 8, but without needing to be welded together.

These three layers 1, 2, 3 of different widths, at least as regards one of them, are first of all aligned so as to make their left-hand edges coincide.

The first manufacturing step of the method consists, in this example, in cutting a tab 4 from the first sheet 1 intended to form the wall of the bag. This tab 4 remains attached to the sheet 1 by one end. The cutting tools are symbolized by the rectangles 5 and 6 in FIG. 2. During this same step, the sheet 3 can be pierced in the middle of its width to form a hole 7 for the passage of a drinking straw. The tools for making this hole 7 are symbolized by a conical punch 8 and a die 9 in FIG. 2. The way in which this hole 7 is made is important. This does not involve cutting this hole 7, but in stretching out the film at a point using the punch 8 in the housing formed in the die 9 until the film 3 bursts. Thus the material of the film surrounding the opening 7 is deformed by flowing, forming a sort of small conical tube 7*a* (FIG. 15) at the bottom of which there is the hole 7. Thus when the drinking straw 21 (FIG. 15) is inserted into the hole 7 from the same side of the film 3 as the punch 8 pierced this hole 7, this hole being sized to have a diameter very slightly smaller than that of the drinking straw 21, the tubular part 7*a* produced during the piercing of this hole 7 grips the drinking straw 21 and forms a seal around it.

As an alternative, it can be envisaged for a roundel of the same plastic as this film 3 to be welded to the film 3 at the place where the hole 7 is to be pierced, so as to reinforce the tubular part surrounding the hole 7.

Figure 3:
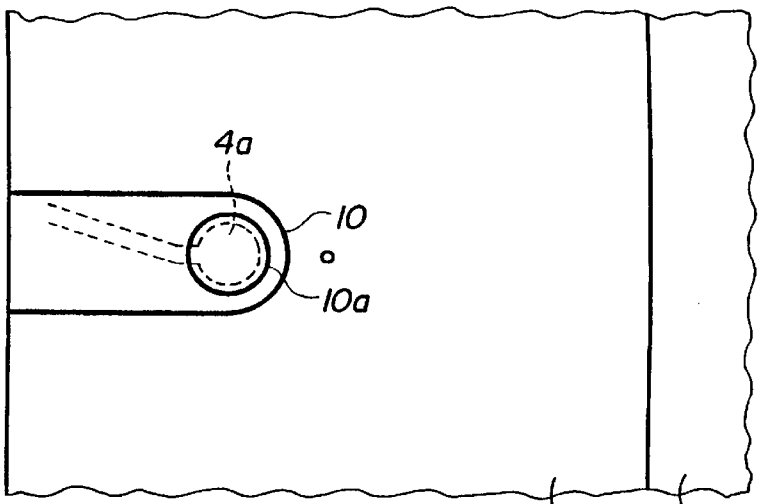
FIG. 3 is a plan view illustrating a second phase of this method.
Figure 4:
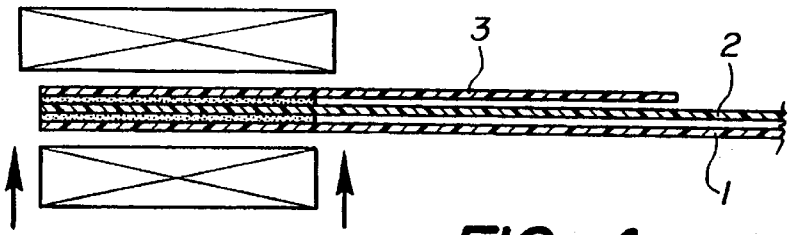
FIG. 4 is a sectional view of FIG. 3.

The next operation, illustrated in FIGS. 3 and 4, consists in welding the three sheets 1, 2, 3 together in the part where the tab 4 has been cut. The weld 10 obtained covers the entire tab 4, but it leaves an unwelded region 10*a* superimposed with the free end 4*a* of the tab 4. Thanks to this weld 10, it will be possible to tear the three sheets of film 1, 2, 3 using the tab 4 as will be explained later.

From the manufacturing method standpoint, this weld 10 is of particular interest. What it actually does is that it allows the three sheets of film 1, 2, 3 to be bonded together in such a way that there can be no more relative movement between them. Now, it is known that plastics are liable to creep when tension has been exerted on them. These sheets also experience significant dimensional variations as a result of variations in temperature, and as a result of variations in moisture content. When working, as is the case here, with a material in strip form which may have a length of as much as several hundred metres, these variations can eventually result in significant offsets. By bonding the films together at the beginning of the manufacturing method, it can be guaranteed that the operations carried out subsequently on the various sheets will be carried out in relative positions which will no longer be able to vary in inconvenient proportions.

Figure 5:
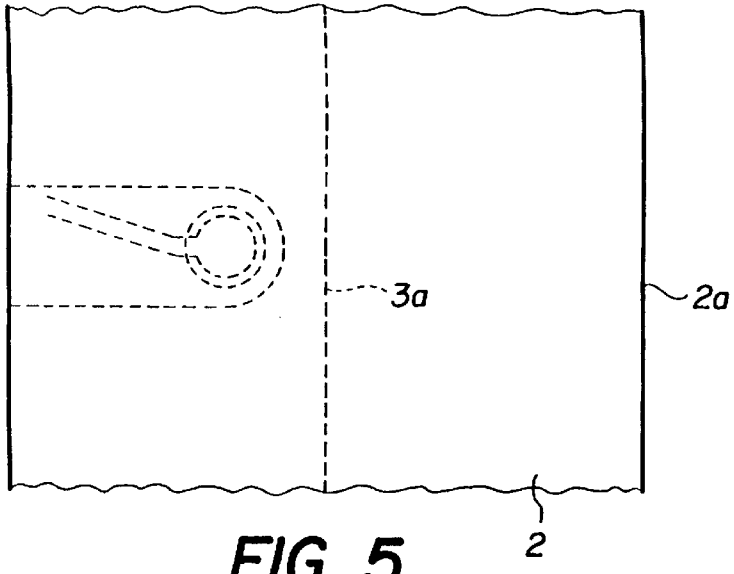
FIG. 5 is a plan view illustrating a third phase of this method.
Figure 6:
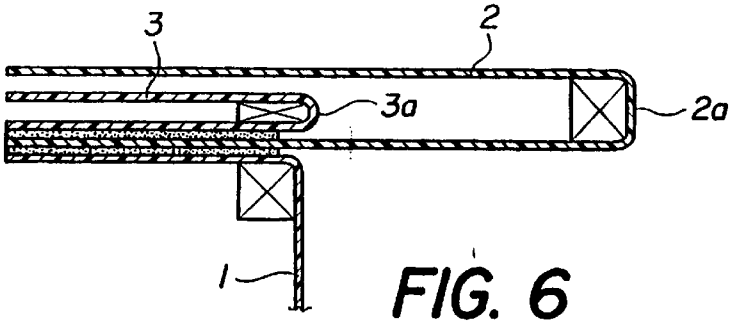
FIG. 6 is a sectional view of FIG. 5.

The next step, illustrated in FIGS. 5 and 6, consists in folding the sheets 2 and 3 over onto themselves in the direction of the width of the strips about two longitudinal axes of folding to form two parallel folds 2*a*, 3*a*. By folding these sheets 2, 3 onto themselves, the longitudinal edges of these sheets 2 and 3 are aligned on the left-hand longitudinal edge, which also corresponds to one of the edges of the sheet 1 forming the wall of the bag. Because of the difference in width of the sheets 2 and 3 in strip form, these folded-over sheets 2, 3 will be superimposed only in that part of the width of these strips which is adjacent to the superimposed edges of these strips. The sheet 1, for its part, is separated from the sheet 2 in order to allow access to the latter.

If the starting material is a single tubular film, as mentioned earlier by way of an alternative, then the next step is to make a fold parallel to the axis of the tube as has already been explained as regards this alternative form.

Figure 7:
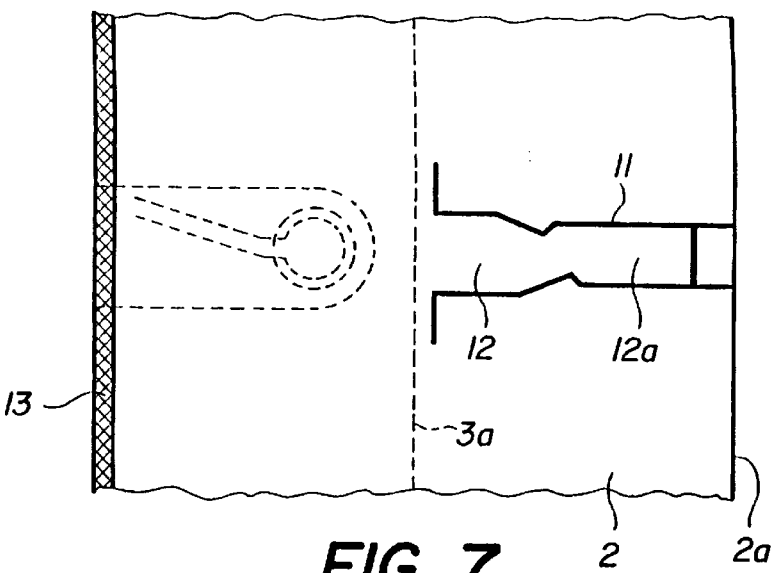
FIG. 7 is a plan view illustrating a fourth phase of this method.

During the step illustrated in FIGS. 7 and 8, two non-converging weld lines 11 are made in that part of the folded-over sheet 2 which is not superimposed with the sheet 3. These weld lines 11 form the edges of a passage 12, between the two folded-over films of the sheet 2, which passage is intended to form the valve 12*a* controlling the dispensing of the liquid packaged in the bag. At the same time, the two longitudinal edges of the folded-over parts of the sheets of film 2 and 3 are fixed together by a longitudinal weld 13. As illustrated in FIG. 8, a separator 14 is inserted between the two folded-over parts of the sheet 3 to keep a longitudinal opening to allow ready access to the inside of the pocket 15 formed between the two films of the folded-over sheet 3. The tools used to weld together the edges 11 of the passage 12 are symbolized in FIG. 8 by two rectangles 16 and 17.

Figure 9:
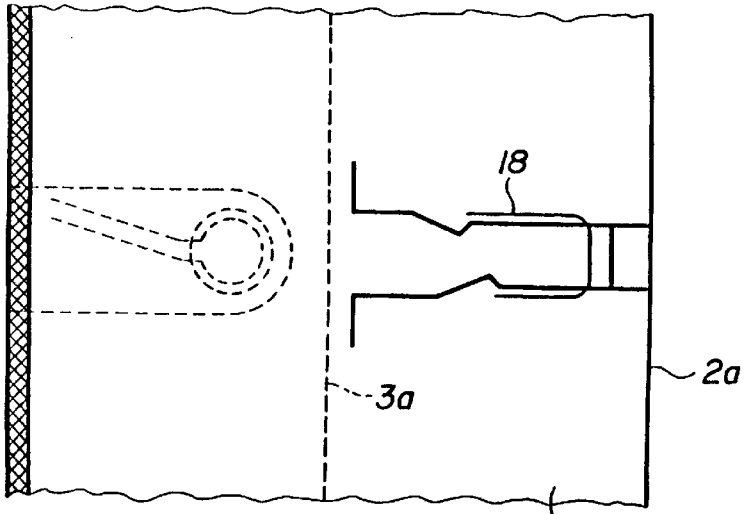
FIG. 9 is a plan view illustrating a fifth phase of this method.
Figure 10:
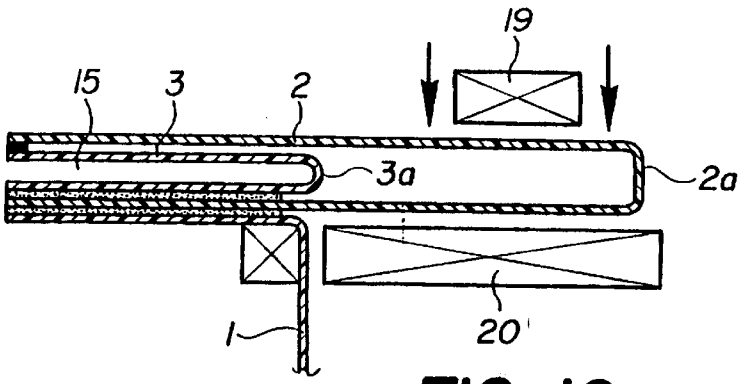
FIG. 10 is a sectional view of FIG. 9.

FIGS. 9 and 10 show the cut-out 18 of the two superimposed films that come from folding the sheet 2, which is carried out using two tools symbolized by the rectangles 19 and 20 in FIG. 10. This cut-out has the shape of a U, the two parallel legs of which are non-symmetric. The transverse leg of this cut-out 18 is close to the end of the passage 12 adjacent to the fold in the sheet 2. This cut-out 18 is intended to make the passage 12 communicate with the inside of the bag. The non-symmetry of the parallel legs of this cut-out 18, which extend one on either side of that part of the passage 12 that forms the valve 12*a* is intended to make it work better, in association with the non-symmetric narrowings of the section of the passage 12.

This stage corresponds to the end of manufacture of the part-finished bag. What this means is that up until this stage in the manufacture, the part-finished bag obtained can be rewound so that it can be transported to another manufacturer so that the liquid can be packaged into the future bags that this manufacturer will finish off by packaging the liquid, as will be explained. Of course, this is merely one possibility to which the invention is obviously not restricted. Indeed, the packaging may be carried out in line following on from the steps in the manufacturing method which have been described hitherto.

Figure 11:
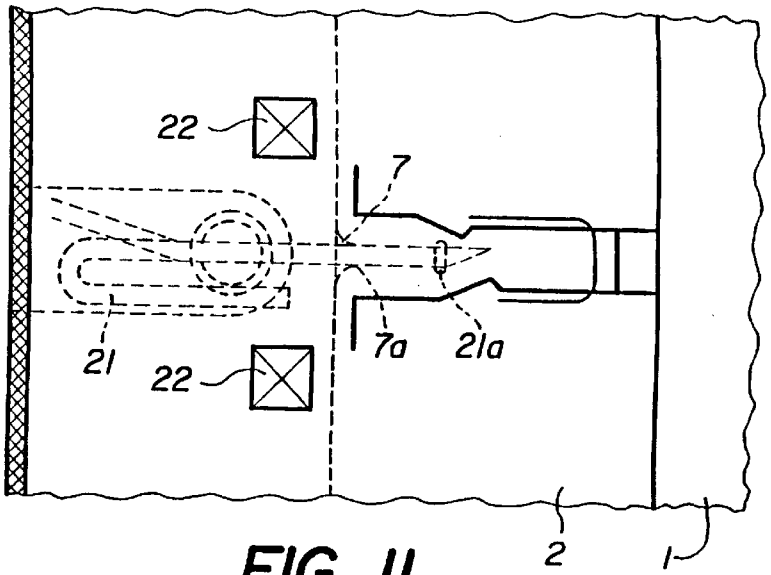
FIG. 11 is a plan view illustrating a sixth phase of this method.
Figure 12:
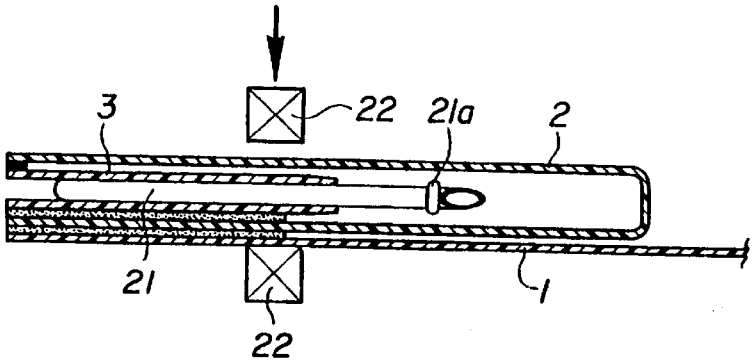
FIG. 12 is a sectional view of FIG. 11.

FIGS. 11 and 12 depict the insertion of the drinking straw 21 between the two folded-over portions of film of sheet 3, until it enters the first part of the passage 12 through the opening 7 formed at the end of the tubular seal 7*a* discussed earlier. Note that in an alternative form, the hole 7 could be made using the drinking straw 21 itself or using a separate tool, just before the drinking straw 21 is inserted rather than during the manufacture of the part-finished bag as was described earlier. In this alternative form, the hole 7 could also be started off during the manufacture of the part-finished bag, to make piercing with the drinking straw 21 easier. As illustrated in these figures, the end of the straw 21 has an annular bulge 21*a* the purpose of which is to offer resistance when the straw 21 is withdrawn from the passage 12 and when this bulge reaches the opening 7. As illustrated in FIGS. 11 and 12, grippers 22 arranged on either side of the drinking straw 21 are used to hold the part-finished bags while the drinking straw 21 is being inserted.

As an alternative, the annular bulge 21*a* of the drinking straw 21 may advantageously be replaced by a deformation of the end of the drinking straw which is turned down outwards over a certain length, advantageously a few mm, as one does with a sock. This turning-down can easily be achieved in the hot state. The turned-down part forms an annular space in which the tubular seal 7*a* can engage when an attempt at withdrawing the drinking straw 21 from this seal is made, thus forming an end stop.

The last step before the liquid is packaged consists in connecting that end of the passage 12 which is adjacent to the fold 3*a* of the third sheet of film 3 to the longitudinal edge where all the longitudinal edges of the sheets 1, 2 and 3 are superimposed by two parallel welds 24, 25. The second longitudinal edge of the first sheet 1 intended to form the wall of the bag 30 will also be fixed along this longitudinal edge, when the liquid is packaged, as will be seen below. These two welds 24 and 25 divide the pocket 15 formed between the two adjacent films of the folded-over sheet 3 into three compartments 31, 32, 33, the last, 33, of which contains the bent-over part of the drinking straw 21. These welds 24 and 25 join together the two folded-over sheets 2 and 3 with the sheet 1 not yet folded over, that is to say that once the bag 30 is finished, the two folded-over sheets 2, 3 will be bonded to one and the same internal face of this bag 30.

Figure 15:
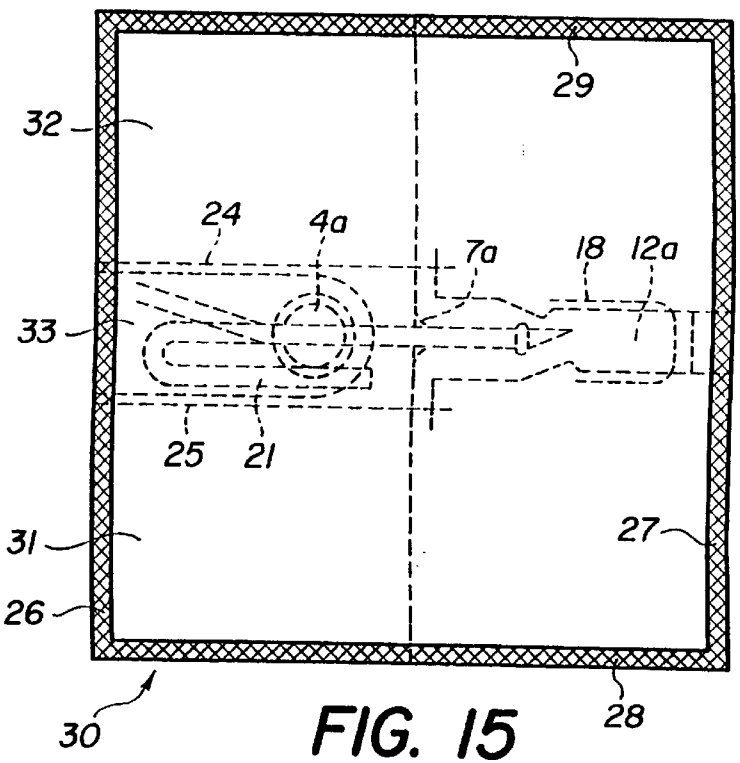
FIG. 15 is a plan view of the finished bag.
Figure 16:
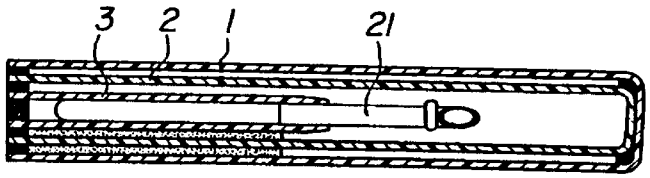
FIG. 16 is a sectional view of FIG. 15.
Figure 13:
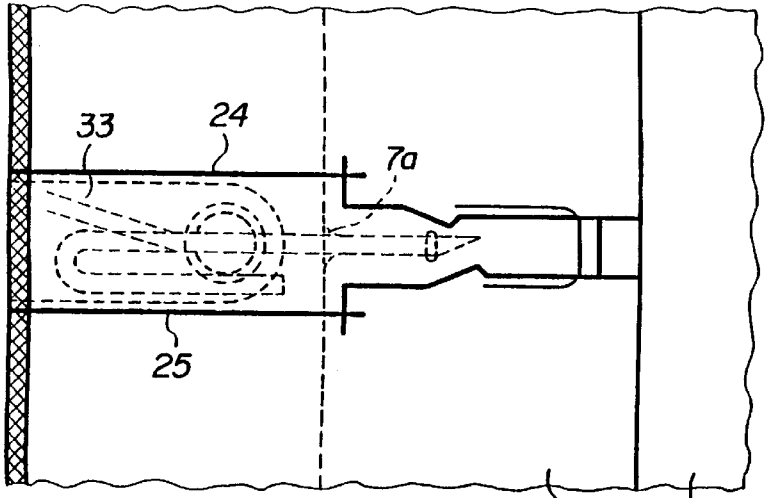
FIG. 13 is a plan view illustrating a seventh phase of this method.
Figure 14:
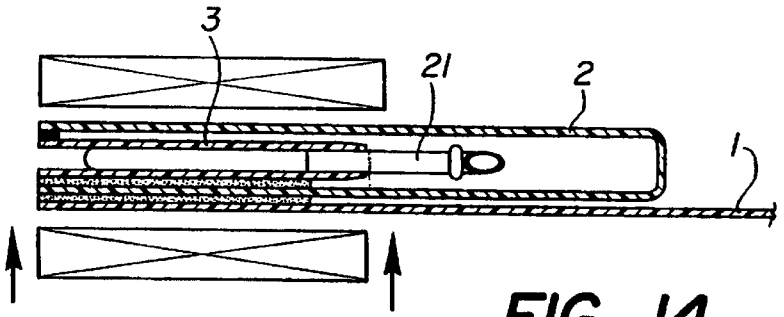
FIG. 14 is a sectional view of FIG. 13.

FIGS. 15 and 16 depict the finished bag 30. This bag is finished off during the packaging of the liquid, and the finishing operations consist in folding the sheet 1 longitudinally around the other two sheets 2 and 3 already folded. Next, the sheets 1, 2 and 3 are welded together longitudinally by a weld 26 that joins together the longitudinal edges of the six layers of the three folded-over sheets 1, 2 and 3 and by another longitudinal weld 27 formed along the adjacent folds of the two folded-over sheets 1 and 2. A third, transverse, weld 28 is formed between the longitudinal welds 26 and 27. This weld 28 is intended to form the bottom of the bag 30 which is then filled via the fourth side which is left open for this purpose, after which the bag is closed by a second transverse weld 29. The bag 30 thus obtained is detached from the material in strip form to which it was attached hitherto by cutting this strip material level with the welds 28 and 29.

As can be seen, the bag 30 has two sealing barriers. One consists of the valve 12*a* formed by the part of the passage 12 situated between that end of this passage 12 adjacent to the cut-out 18 and the non-symmetric restrictions leading to a widened-section part of this passage. Another is formed between the drinking straw 21 and the tubular seal 7*a*.

To consume the contents of the bag 30, when this is a drink, all that is required is for the end 4*a* of the tab 4 to be gripped and pulled towards the weld 26, thus tearing the three superimposed layers which are welded together by the weld 10, at the welds 24 and 25, thus giving access to the inside of the compartment 33 containing the bent-over part of the drinking straw 21. The end of this bent-over part is gripped and is moved towards the outside of the compartment 33, the drinking straw 21 is then pushed further into the passage 12 in order to part the part of the adjacent films of the sheet 2 forming the valve 12*a*, and the liquid is sucked up through the drinking straw 21. If one does not wish to consume the entire contents of the bag 30, all that is required is for the drinking straw to be withdrawn to the position illustrated in FIG. 15 so that the valve 12*a* formed in the passage 12 closes back up. As to the liquid in the rest of the passage 12, it is prevented from coming out thanks to the seal 7*a* which grips the drinking straw 21 around the opening 7 formed through the sheet 3. As a result of this, the outside of the bag always remains clean and dry. The seal 7*a*, in cooperation with the annular bulge 21*a* in the drinking straw 21, also serves to avoid accidental withdrawal of the drinking straw 21 from the passage 12. This is why it may be beneficial for the portion of the film 3 forming this seal 7*a* to be locally reinforced, as was mentioned earlier.

The closed compartments 31, 32 lying one on either side of the compartment 33 containing the bent-over part of the drinking straw 21 are isolated from the main chamber of the bag 30 intended to contain the liquid, which chamber is formed between the two folded-over parts of the sheet 1. These compartments could be used to accommodate all kinds of articles, objects, treats, offers, games or parts of games, etc., which can be inserted during the operation of packaging the liquid in the main chamber of the bag 30.

In a last alternative form of this first embodiment, it is envisageable to start off with a single sheet or strip folded longitudinally to produce the assembly of the chamber and of the valve that were described earlier, an approach which is not in any way impossible as far as the method according to the present invention is concerned. It should nonetheless be pointed out that to the best of our knowledge at the present time of plastics available on the market, it is preferable for the wall 1 of the bag to be formed from a PE/PET laminate. Now, PET will not weld to itself, which means that it cannot be used for the layers 2 and 3. Furthermore, sheets formed of just PE to form the walls of the bag do not give very good results as regards the tearing of the tab 4 to open the bag. In the tests carried out, we obtained excellent results as far as forming the wall of the bag was concerned, with PE/PET sheets in which the respective thicknesses were 100 and 12 $\mu$m, the thin layer of PET making it possible to obtain a clean cut by the tab 4 at the time of opening.

The various steps of the method described earlier will need to be modified a little to suit the methods of manufacture adopted; a step-by-step method of manufacture or a method of manufacture in which the strip or strips advance continuously and in which the operating members on the production line are of the rotary type may be adopted. A method of manufacture of this kind can achieve higher production rates and is therefore potentially more attractive. If a tubular film is being used to produce the folded-over sheets 2 and 3, as mentioned earlier by way of an alternative, then the tubular element needs to be moving continuously anyway.

To make continuous movement possible in all scenarios, it may be necessary, especially for some of the welding operations, to provide a device for accumulating strip in zig zags over rollers suspended elastically on either side of the strip, so that it can even itself out progressively into a line should there be a temporary stoppage of this strip upstream. A device of this kind is not needed if the welding stations are of the "accompanying" type.

To allow some of the superimposed sheets and not others to be welded together selectively, separators are inserted into the corresponding parts of the path of the strip or strips of films. In the case of "accompanying" welds, the separators will be moved back and forth in the direction of travel of these strips to allow them to follow the movement of the welding electrodes or of the cutting punches.

Given that the bags fitted with valves according to the invention can be produced from one, two or three sheets, one of which may be tubular, it may be preferable to begin the method by folding the sheets so as to bring them, before welding or cutting, into the position illustrated in FIG. 6, after which the cutting and welding operations are begun in the order described earlier. It can, however, be mentioned that the weld 10 superimposed with the tab 4 and around the end 4*a* of this tab 4 may preferably be produced at the same time as the weld 11 of the passage 12 of the valve illustrated in FIG. 7.

As already mentioned earlier, the piercing of the opening to allow the drinking straw 21 to access the passage 12 of the valve in a leaktight fashion, made in the fold 3*a* of the sheet 3, may be carried out during the operation of packaging the liquid in the bag.

Figure 17:
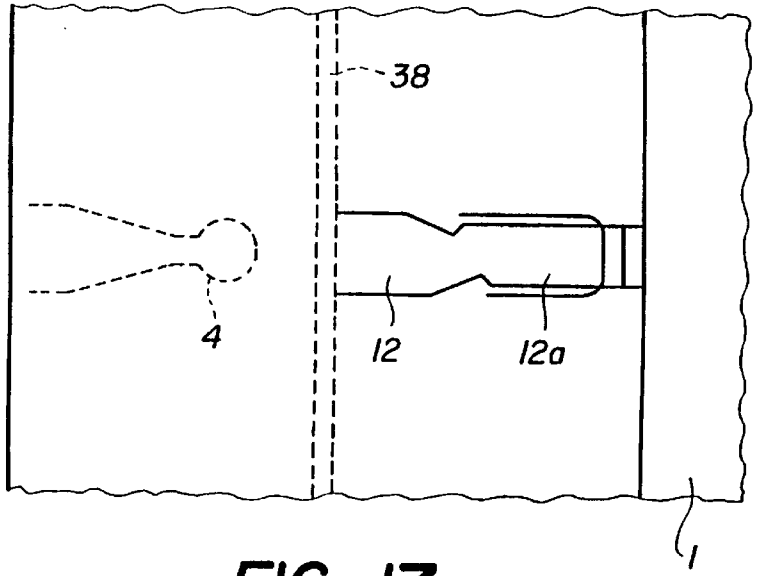
FIG. 17 is a plan view of the fourth phase of a second embodiment of the method for manufacturing and packaging liquid in a bag according to a second embodiment that is a subject of the present invention.
Figure 19:
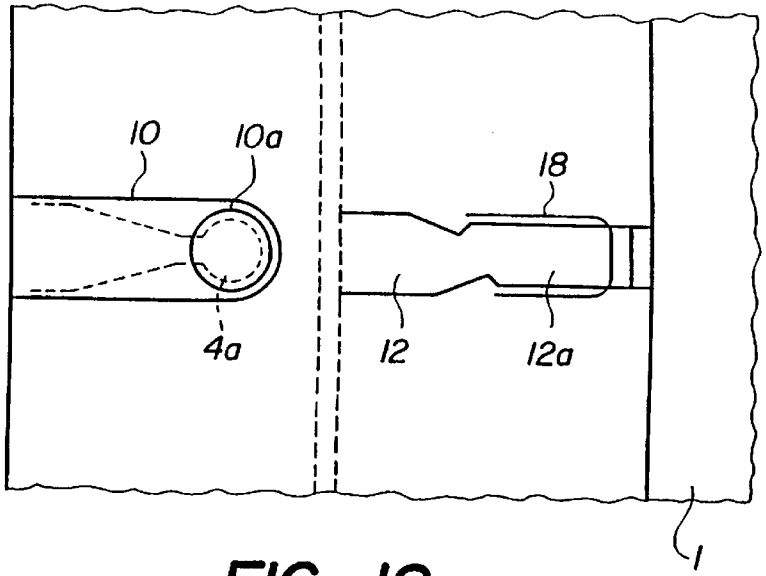
FIG. 19 is a plan view of the fifth phase of this method.
Figure 18:
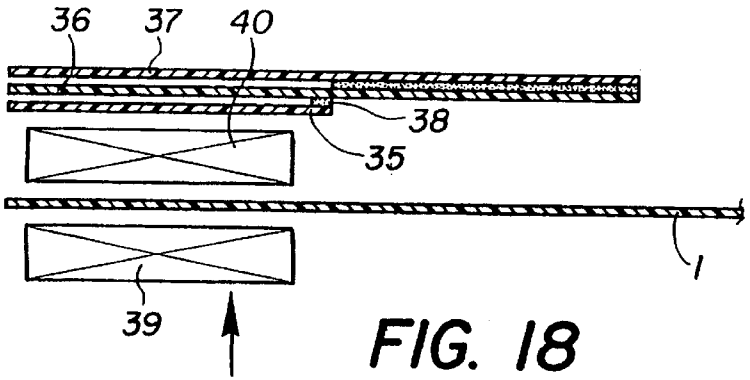
FIG. 18 is a sectional view of FIG. 17.
Figure 20:
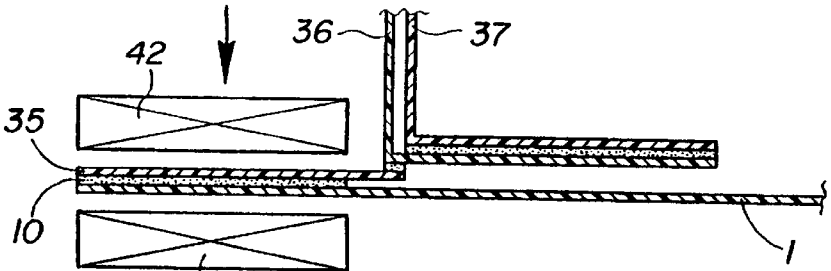
FIG. 20 is a sectional view of FIG. 19.

The bag according to the second embodiment, the method of manufacture of which is illustrated by FIGS. 17 to 24, differs from the one described earlier essentially in the fact that the pocket 15 is no longer formed inside a folded-over sheet, as it was earlier, but between a sheet 35 and a sheet 36, between which the passage 12 of the valve 12*a* is formed by the two non-converging welds 11. Unlike in the previous embodiment, this passage 12 is preferably not formed of a sheet folded 3 about a longitudinal axis of the strip film, but between two sheets 36, 37. The internal longitudinal edge of the sheet 35 is welded along the line 38 to the sheet 36 forming one of the walls of the passage 12 (FIGS. 17 and 18).

In this second embodiment, most of the steps of the method are similar to those of the first embodiment, and so to avoid needless repetition, these steps have been neither depicted nor described.

Like in the first embodiment, the wall of the bag is preferably formed of a single sheet 1 intended to be folded longitudinally at a later stage. A tab 4 is cut in this sheet 1 (FIGS. 17, 18) by cutting tools 39, 40, and this tab 4 is welded to the sheet 35 by a weld 10, with the exception of its end 4*a* which is in the unwelded region 10*a* (FIGS. 19, 20), by welding tools 41, 42. As before, this weld 10 extends right around the tab 4 to isolate it from the liquid inside the bag.

Next, the sheet 1 forming the wall of the bag is folded longitudinally in two to make its two edges meet, these edges being aligned with one of the edges of each band of film 35, 36 and 37. This step marks the last step in the method of manufacturing the part-finished bag according to the present invention. There are then two conceivable possibilities: either the strip along which a number of uniformly spaced part-finished bags follow on from one another continues as far as a liquid-packaging unit, or this strip of part-finished bags is wound onto a reel to be transported to a separate packaging unit.

Figure 23:
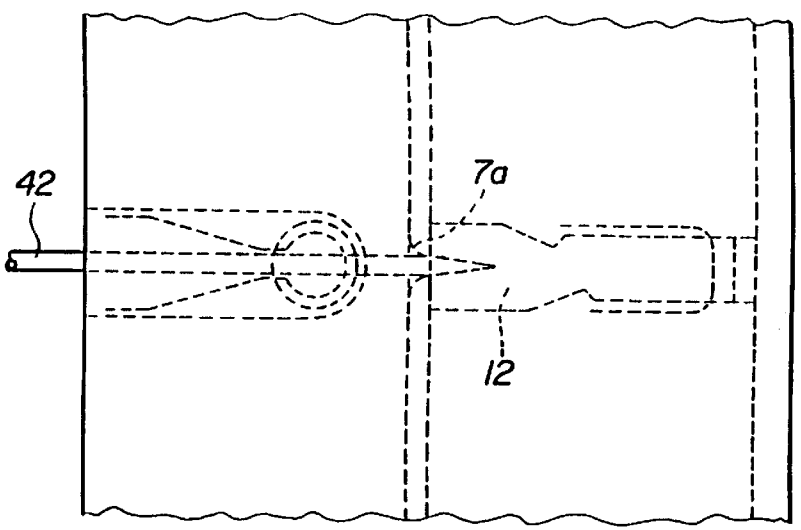
FIG. 23 is a plan view of the first phase of the process of packaging liquid in the bag according to the second embodiment.
Figure 24:
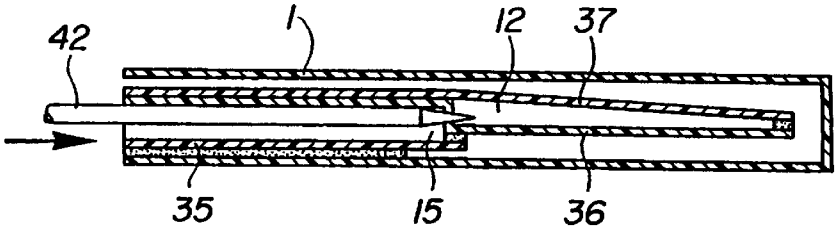
FIG. 24 is a sectional view of FIG. 23.
Figure 21:
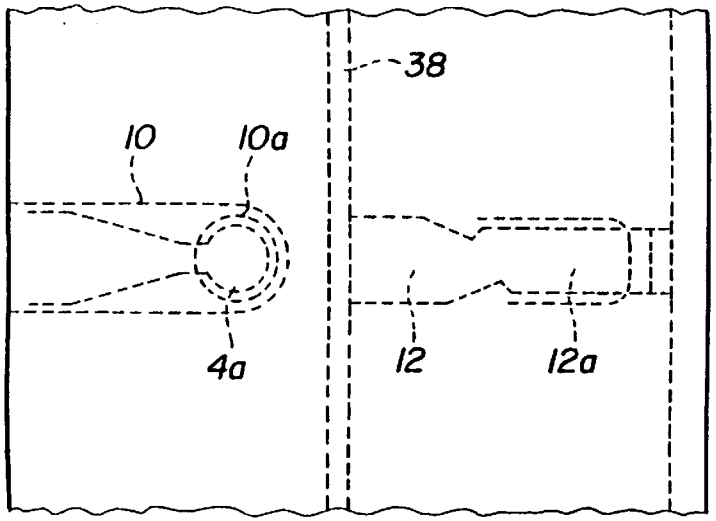
FIG. 21 is a plan view of a later phase of this method.
Figure 22:
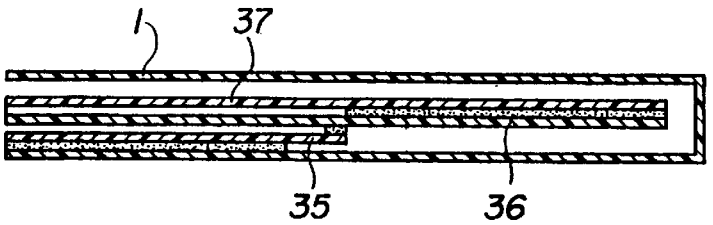
FIG. 22 is a sectional view of FIG. 21.

FIGS. 23 and 24 illustrate the first step in the packaging process, the other steps will not be described as reference need merely be made back to the previous embodiment in which the subsequent steps relating to the packaging process are the same as for this second embodiment.

Whereas in the first embodiment, the tubular seal 7*a* was formed in the folded-over sheet 3, at the site of its longitudinal fold, in this embodiment, the tubular seal 7*a* is formed by piercing the film 36 forming a wall of the passage 12 and of the pocket 15, adjacent to the film 35 forming the other wall of this pocket 15, using a tool 42.

As far as the rest of the operations relating to the insertion of the drinking straw 21, to the filling with liquid and to the closing of the bag are concerned, as these are similar to those described in relation to the previous embodiment, reference need merely be made back to that part of the description that deals with the packaging of the liquid in this first embodiment.

One of the advantages of the manufacturing method of this second embodiment of bag arises out of the fact that the film 1 intended to form the wall of the bag stays flat and does not need to be pulled downwards as it did in the first embodiment, and this allows the material in strip form to be pulled under better conditions.

The bag equipped with a valve 12*a* constitutes the preferred embodiment of the invention. However, given the effectiveness of the tubular seal 7*a*, this valve could be dispensed with provided that up until the first time it is used, the dispensing pipe 21 of the bag is plugged by a removable seal such as a stopper, then after it has been used for the first time, the bag is either restoppered or always held in a position in which the outlet opening of the dispensing pipe 21 is not below the level of the liquid in the bag.

What is claim is:

1. A bag for packaging liquid formed using plastic in film form, comprising a leaktight chamber for the liquid and a pocket, adjacent to this chamber, in which a pipe for withdrawing the liquid is housed, means being provided to give access to the inside of said pocket, an opening being formed through part of the wall of this pocket, adjacent to said chamber to allow said withdrawing pipe to enter said chamber in a leaktight fashion, wherein said opening is situated at the end of a tubular element of decreasing section, at the place where the section is the smallest, the element being formed from a film of plastic forming one wall of said pocket adjacent to said chamber, this tubular element being intended to accommodate said pipe for withdrawing the liquid from the chamber, the section of which is at least equal to that of said opening, so that said tubular element forms a seal around said withdrawing pipe.

2. The bag according to claim 1, wherein said means for giving access to the inside of said pocket comprise a tab cut from one of the layers of film intended to form said chamber and wherein said tab, with the exception of its free end, is attached to one of the layers of film forming said pocket, this attachment also extending right around the periphery of the tab.

3. The bag according to claim 1, wherein said bag comprises a first layer of film forming one of the walls of said chamber and a second layer of film, two edges of these first and second layers being adjacent to one another, while the opposite edge of the second layer is situated an appreciably shorter distance away from these adjacent edges than the opposite edge of the first layer, a third layer of film covers the second layer, one of the edges of said third layer of film being aligned with the adjacent edges of the first and second layers, the second and third layers being attached along the free edge of the second layer to form the bottom of said pocket, the opposite edge of this third layer to said adjacent edges extending beyond the bottom of said pocket, a fourth layer of film, two opposite edges of which coincide with those of the third layers being between the bottom of said pocket and their edges which lie beyond this bottom, along two non-converging lines to form a passage, the axis of which is approximately perpendicular to said bottom, this passage communicating on the one hand with said opening and on the other hand with the inside of said chamber, the walls of this passage being intended to be parted by said dispensing pipe and to close back up in the absence of this pipe in order to control the passage of the liquid, a fifth layer of film, forming the second wall of this chamber, being attached around the periphery of the first layer of film.

4. The bag according to claim 1, wherein said bag contains a passage which is open at both ends for controlling the flow of liquid between the inside and the outside of the bag, this passage being formed between two adjacent layers of film of plastic joined together along two non-converging connecting lines, the opening of the section of this passage being obtained by parting said layers of film from one another, two other adjacent layers of film which come from one and the same film of plastic folded over on itself and whose length, perpendicular to the axis of folding, is appreciably shorter than the corresponding length of said two first layers of film being inserted between them, the other end of said passage being adjacent to said fold, said tubular element of conical shape being formed across said fold and entering the opening of said passage, which opening is adjacent to this fold.

5. The bag according to claim 4, wherein the wall is formed by folding a film on itself about an axis parallel to the axis about which the second pair of films is folded.

6. The bag according to claim 5, wherein two said layers of film come from one and the same sheet folded about three parallel axes.

7. The bag according to claim 4, wherein said common sheet is formed by a tube.

8. The bag according to claim 1, wherein said pocket is divided into a number of compartments.

9. The bag according to claim 2, wherein said bag comprises a first layer of film forming one of the walls of said chamber and a second layer of film, two edges of these first and second layers being adjacent to one another, while the opposite edge of the second layer is situated an appreciably shorter distance away from these adjacent edges than the opposite edge of the first layer, a third layer of film covers the second layer, one of its edges bing aligned with the adjacent edges of the first and second layers, these second and third layers being attached along the free edge of the second layer to form the bottom of said pocket, the opposite edge of this third layer to said adjacent edges extending beyond the bottom of said pocket, a fourth layer of film, two opposite edges of which coincide with those of the third layers being between the bottom of said pocket and their edges which lie beyond this bottom, along two non-converging lines to form a passage, the axis of which is approximately perpendicular to said bottom, this passage communicating on the one hand with said opening and on the other hand with the inside of said chamber, the walls of this passage being intended to be parted by said dispensing pipe and to close back up in the absence of this pipe in order to control the passage of the liquid, a fifth layer of film, forming the second wall of this chamber, being attached around the periphery of the first layer of film.

10. The bag according to claim 2, wherein said bag contains a passage which is open at both ends for controlling the flow of liquid between the inside and the outside of the bag, this passage being formed between two adjacent layers of film of plastic joined together along two non-converging connecting lines, the opening of the section of this passage being obtained by parting said layers of film from one another, two other adjacent layers of film which come from one and the same film of plastic folded over on itself and whose length, perpendicular to the axis of folding, is appreciably shorter than the corresponding length of said two first layers of film being inserted between them, the other end of said passage being adjacent to said fold, said tubular element of conical shape being formed across said fold and entering the opening of said passage, which opening is adjacent to this fold.

11. The bag according to claim 10, wherein the wall is formed by folding a film on itself about an axis parallel to the axis about which the second pair of films is folded.

12. The bag according to claim 11, wherein two said layers of film come from one and the same sheet folded about three parallel axes.

13. The bag according to claim 10, wherein said common sheet is formed by a tube.

14. A method for the manufacture of bags and for packaging liquid in said bags continuously, comprising the steps of, starting from a film of plastic in strip form, wherein said film in strip form is made to travel longitudinally and wherein the bottom of said pocket is formed between two layers of film in strip form by attaching two films in strip form or by longitudinally folding a film in strip form, two layers of film in strip form appreciably wider than the depth of said pocket and intended to form said chamber are superimposed with the two faces of said pocket and one of their respective edges is aligned with the edges of the opening of said pocket so that access can be had laterally between these layers of film and wherein these layers are made to travel vertically downwards, the layers of film forming said pocket are parted, and said tubular seal and said opening are formed through a portion of its wall adjacent to said chamber, a pipe for withdrawing the liquid fron the chamber is inserted through this tubular seal, two attachment lines appreciably perpendicular to the fold line or join line of the walls of the pocket are formed, one on either side of said withdrawing pipe, between this fold or this join line and the edge of said strip where the various layers of film are aligned, these two attachment lines joining together the layers of film forming the pocket to the layer of film forming the wall of the chamber equipped with the means provided to give access to the inside of said pocket, all the layers of film are then attached, on the one hand transversely to said strip of film, on the other hand, along the two longitudinal edges of said strip of film in order to form said chamber, the upper edge of which is open, this chamber is then filled through this open edge and said bag is closed by attaching all the layers, transversely, along the upper edge of this chamber.

15. The method according to claim 14, said pocket is formed by arranging a second layer of film in strip form over a first layer forming one of the walls of said chamber, two longitudinal edges of this first layer and of this second layer being adjacent to one another, the width of this second layer corresponding to the depth of said pocket, a third layer of film in strip form which is wider is arranged over the second layer, the two layers forming said pocket are attached in the longitudinal direction of said film in strip form, approximately along the edge of the narrowest layer corresponding to the bottom of said pocket, a fourth layer of film in strip form with the same width as the third layer is added, this third layer and this fourth layer are attached between said longitudinal attachment forming the bottom of said pocket and their edges which lie beyond this bottom, along two non-converging lines to form a passage, the axis of which is more or less perpendicular to said longitudinal attachment, and a fifth layer is added to form the second wall of said chamber.

16. The method according to claim 14, wherein three strips of film are superimposed, a first strip intended to form the wall of the chamber, a second strip intended to form a passage forming a valve to control the flow of liquid, and a third intended to close the passage of said valve in a leaktight fashion, the width of this third strip being appreciably less than that of the second strip, wherein one of the respective longitudinal edges of these superimposed strips is made to coincide, wherein said second strip and said third strip are folded onto themselves so that their other respective longitudinal edges are superimposed with their three respective longitudinal edges that were aligned earlier so that the folded-over third strip stretches between the two superimposed halves of the second strip over a portion of its width, wherein the edges of said passage are attached in the part of said folded-over second strip which is not superimposed with the third strip folded over on itself and, at the same time, the folded-over edges of said second and third strips are attached to one another, and wherein said passage is cut near its end adjacent to the fold of said second strip.

17. The method according to claim 16, wherein said second and third strips of film are folded, said three strips are welded together in a region superimposed with said tab, leaving within this region an unwelded portion opposite the free end of the tab.

18. The method according to claim 14, wherein said method takes place in two separate phases, one consisting in forming a continuous strip of part-finished bags in which all the layers are attached to one another but are separate from one another along at least one longitudinal edge and along the transverse edges and the second consisting in forming said tubular seal, in inserting said withdrawing pipe therein and in packaging the liquid in said chamber.

19. The method according to claim 15, wherein said method takes place in two separate phases, one consisting in forming a continuous strip of part-finished bags in which all the layers are attached to one another but are separate from one another along at least one longitudinal edge and along the transverse edges and the second consisting in forming said tubular seal, in inserting said withdrawing pipe therein and in packaging the liquid in said chamber.

20. The method according to claim 16, wherein said method takes place in two separate phases, one consisting in forming a continuous strip of part-finished bags in which all the layers are attached to one another but are separate from one another along at least one longitudinal edge and along the transverse edges and the second consisting in forming said tubular seal, in inserting said withdrawing pipe therein and in packaging the liquid in said chamber.

21. The method according to claim 17, wherein said method takes place in two separate phases, one consisting in forming a continuous strip of part-finished bags in which all the layers are attached to one another but are separate from one another along at least one longitudinal edge and along the transverse edges and the second consisting in forming said tubular seal, in inserting said withdrawing pipe therein and in packaging the liquid in said chamber.

* * * * *

UNITED STATES PATENT AND TRADEMARK OFFICE

CERTIFICATE OF CORRECTION

PATENT NO. : 6,216,426 B1
DATED : April 17, 2001
INVENTOR(S) : Xavier De Saint-Sauveur It is certified that error appears in the above-identified patent and that said Letters Patent is hereby corrected as shown below:

Title page,
Please insert -- Foreign Application Priority Data -- -- December 23, 1996, (FR) 9616314 --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*